US010355428B2

(12) United States Patent
Fang et al.

(10) Patent No.: US 10,355,428 B2
(45) Date of Patent: Jul. 16, 2019

(54) CARD EDGE CONNECTOR WITH HOLES FOR TRANSFERRING LIGHT

(71) Applicant: FOXCONN INTERCONNECT TECHNOLOGY LIMITED, Grand Cayman (KY)

(72) Inventors: Jun Fang, Kunshan (CN); Xiao-Hu Yin, Kunshan (CN); Kuo-Chun Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/937,834

(22) Filed: Mar. 27, 2018

(65) Prior Publication Data

US 2018/0287310 A1 Oct. 4, 2018

(30) Foreign Application Priority Data

Mar. 29, 2017 (CN) ..... 2017 1 0197603

(51) Int. Cl.
*H01R 13/717* (2006.01)
*H01R 13/6581* (2011.01)
(Continued)

(52) U.S. Cl.
CPC ..... *H01R 13/7175* (2013.01); *H01R 12/7005* (2013.01); *H01R 12/721* (2013.01);
(Continued)

(58) Field of Classification Search
CPC ..... H01R 13/502; H01R 13/7175; H01R 13/6581
(Continued)

(56) References Cited

U.S. PATENT DOCUMENTS 5,030,140 A * 7/1991 Sugiyama ..... H01R 13/6594 439/607.35
5,730,609 A * 3/1998 Harwath ..... H01R 12/721 439/108
(Continued)

FOREIGN PATENT DOCUMENTS

CN 2884569 Y 3/2007
CN 204834944 U 12/2015
(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A card edge connector includes a longitudinal insulative housing, a number of terminals retained in the insulative housing, a pair of transparent members mounted to the insulative housing, and a metallic shell surrounding around the insulative housing. The insulative housing has two side walls extending along a longitudinal direction, two end walls connecting between the longitudinal ends of the two side walls and a center slot defined therebetween. The metallic shell includes two covering portions respectively located above the two side walls in a vertical direction perpendicular to the longitudinal direction. Each of the covering portions has a number of through-holes arranged above the transparent members to leak out the light transferred therefrom.

18 Claims, 17 Drawing Sheets

(51) Int. Cl.

| | |
|---|---|
| ***H01R 12/73*** | (2011.01) |
| ***H01R 12/70*** | (2011.01) |
| ***H01R 12/72*** | (2011.01) |
| ***H01R 13/6594*** | (2011.01) |
| *H01R 13/635* | (2006.01) |

(52) U.S. Cl.
CPC ..... *H01R 12/737* (2013.01); *H01R 13/6581* (2013.01); *H01R 13/6594* (2013.01); *H01R 13/7172* (2013.01); *H01R 13/635* (2013.01)

(58) Field of Classification Search
USPC .... 439/607.01, 2, 22, 23, 25, 152–157, 108, 439/137
See application file for complete search history.

(56) References Cited

U.S. PATENT DOCUMENTS 6,093,046 A * 7/2000 Chiou ..... H01R 12/7005 439/378
6,319,060 B1 * 11/2001 Wu ..... H01R 13/658 439/607.13
6,390,833 B1 * 5/2002 Chang ..... H01R 13/6485 439/108
6,485,328 B1 * 11/2002 Wu ..... H01R 13/658 439/567
6,634,894 B1 * 10/2003 Ko ..... H01R 23/6873 439/108
6,672,887 B1 * 1/2004 Yu ..... H01R 13/6582 439/108
6,749,445 B1 * 6/2004 Chen ..... H05K 3/301 439/65
6,755,671 B1 * 6/2004 Fan ..... H01R 13/658 439/108
7,083,448 B2 8/2006 Tanigawa
7,083,470 B2 * 8/2006 Zhang ..... H01R 23/6873 439/607.36
7,108,554 B2 * 9/2006 Huang ..... H01R 23/6873 439/378
7,137,746 B2 * 11/2006 Kato ..... G02B 6/4204 385/94
7,217,042 B2 * 5/2007 Okada ..... G02B 6/4292 385/88
7,364,370 B2 * 4/2008 Nishizawa ..... G02B 6/421 385/88
8,641,299 B2 * 2/2014 Daikuhara ..... G02B 6/4204 385/93
9,065,221 B2 * 6/2015 Kimura ..... H01R 12/71
9,065,225 B2 * 6/2015 Degner ..... H01R 12/721
9,360,639 B2 * 6/2016 Choraku ..... G02B 6/423
9,570,823 B2 * 2/2017 Lai ..... H01R 12/716
9,666,971 B1 * 5/2017 Lai ..... H01R 13/5025
9,780,512 B2 10/2017 Hsu et al.
2005/0095913 A1 * 5/2005 Fan ..... H01R 13/658 439/607.35
2005/0277334 A1 * 12/2005 Huang ..... H01R 23/6873 439/607.01
2015/0132985 A1 * 5/2015 Choi ..... H01R 13/6275 439/345
2016/0020537 A1 * 1/2016 Ju ..... H01R 24/78 439/83
2017/0033508 A1 * 2/2017 Hsu ..... H01R 13/405

FOREIGN PATENT DOCUMENTS

CN 107204534 A 9/2017
CN 107204544 A 9/2017

* cited by examiner

CARD EDGE CONNECTOR WITH HOLES FOR TRANSFERRING LIGHT

FIELD OF THE DISCLOSURE

The invention is related to a card edge connector, and particularly to a card edge connector with a lot of holes for transferring light.

DESCRIPTION OF RELATED ARTS

Currently, a card edge connector is used to connect a card module card to a printed circuit board. The card edge connector includes an insulative housing, a plurality of terminals retained in the insulative housing and an ejector pivotally mounted to the insulative housing. The insulative housing includes two side walls, a center slot located between the two side walls and a tower-shaped portion protruding upwardly from the side walls. However, the demand of the appearance and the light effect of the card edge connector gradually becomes apparent in the market as the development of the connectors.

Therefore, it is desired to provide a new card edge connector.

SUMMARY OF THE DISCLOSURE

To achieve the above desire, a card edge connector includes a longitudinal insulative housing having two side walls extending along a longitudinal direction, two end walls extending along a transverse direction and connecting between the longitudinal ends of the two side walls and a center slot defined therebetween; a plurality of terminals retained in the said walls, respectively; a pair of transparent members fixed to the said walls, respectively; a metallic shell surrounding around the insulative housing. The metallic shell comprises two covering portions respectively located above the two side walls in a vertical direction perpendicular to both of the longitudinal direction and the transverse direction. Each of the covering portions comprises a plurality of through-holes arranged along the longitudinal direction and located above the transparent members to leak out the light transferred therefrom.

DETAILED DESCRIPTION OF THE PREFERRED EMBODIMENT

Figure 1:
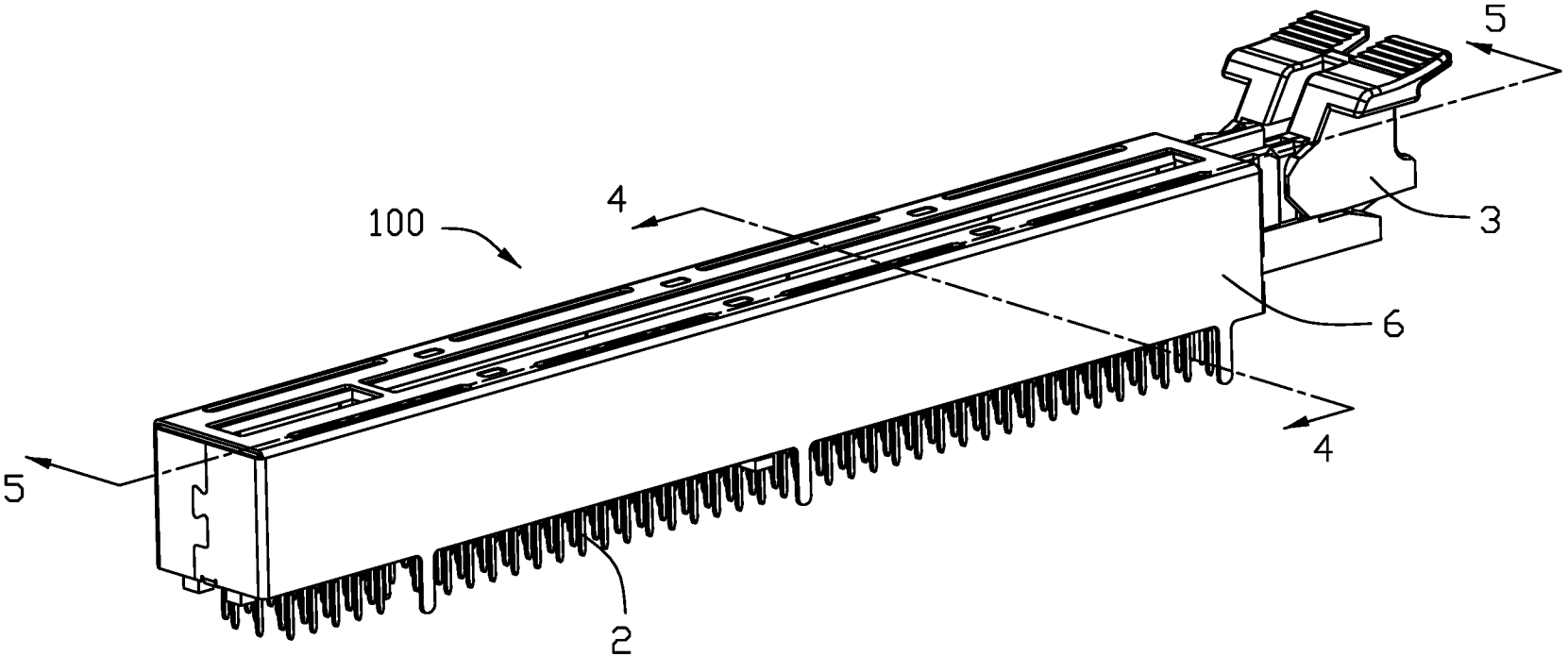
FIG. 1 is a perspective view of a card edge connector according to a first embodiment of the present invention.

Reference will now be made in detail to the embodiments of the present disclosure. Referring to FIGS. 1-5, a card edge connector 100 is used to electrically connect a card module (not shown) with a mother board (not shown). The card edge connector 100 includes a longitudinal insulative housing 1, a plurality of terminals 2 retained in the insulative housing 1, an ejector 3 pivotally mounted to an end of the insulative housing 1, a pair of metallic members 4 retained in the insulative housing 1, a pair of transparent/translucent members or light guide pieces 5 mounted to the insulative housing 1, a metallic shell 6 surrounding around the insulative housing 1, and a LED (Light Emitting Diode) 7 fixed to a bottom side of the insulative housing 1.

The insulative housing 1 includes two side walls 11 extending along a longitudinal direction, two end walls 12 connecting between the longitudinal ends of the two side walls 11, and a center slot 13 defined therebetween. The card module (not shown) is inserted into the center slot 13 to electrically connect with the terminals 2. Each of the side walls 11 includes a plurality of terminal slots 112 communicating with the center slot 13. The terminal slots 112 go through two top surfaces of the two side walls 11 along a vertical direction, respectively. Each of the side walls 11 includes a groove 111 for receiving the transparent member 5. Each of the grooves 111 goes through the top surface of the side wall 11 so that the transparent member 5 would be exposed to the top surface of the side wall 11. Each of the side walls 11 includes a plurality of first positioning portions 113 protruding upwardly from the top surface of the side wall 11. The first positioning portions 113 are located between the terminal slots 112 and the grooves 111 in a transverse direction perpendicular to the longitudinal direction.

The plurality of terminals 2 are retained in the terminal slots 112, respectively. Each of the terminals 2 includes a retaining section 21 retained in the insulative housing 1, a contacting section 22 extending upwardly from the retaining section 21 into the center slot 13, and a soldering section 23 extending downwardly from the retaining section 21 and beyond the insulative housing 1.

The ejector 3 includes a base portion 31, two shafting portions 32 protruding from two corresponding opposite sides of the base portion 31, two supporting portions 34 extending upwardly from the base portion 31, two operating portions 33 extending outwardly from a top side of the supporting portions 34, respectively. The ejector 3 includes two hooks 35 respectively extending from the supporting portions 34 to the center slot 13 for hooking with the insulative housing 1.

Each of the transparent members 5 includes a longitudinal main portion 51 and an extending portion 52 extending downwardly therefrom. The length of the extending portion 52 is shorter than the length of the main portion 51 in the longitudinal direction so that the transparent members 5 would be easily mounted into the grooves 111. Each of the extending portions 52 is exposed to a bottom surface of the side walls 11, respectively.

The metallic shell 6 includes two long walls 61 respectively covering the two side walls 11, two short walls 62 connecting therebetween, a plurality of soldering pins 63 extending downwardly from a bottom side of the long walls 61, and two covering portions 64 located above the top surfaces of the two side walls 11 in the vertical direction, respectively. Each of the covering portions 64 extends from a top side of one side wall 11 to the center slot 13. The metallic shell 6 includes a longitudinal gap 65 between the two covering portions 64. The gap 65 is aligned to the center slot 13. The insulative housing 1 has an interval portion 14 located between the two side walls 11. The metallic shell 6 includes a connecting portion 66 connecting between the two covering portions 64. The connecting portion 66 covers on the interval portion 14. Each of the covering portions 64 includes a plurality of through-holes 641 spaced from each other along the longitudinal direction, a plurality of blocking portions 642 located between the through-holes 641, and a plurality of second positioning portions 643 located between the blocking portions 642 and the gap 65 in the transverse direction. The through-holes 641 are a plurality of long strip holes respectively located above the two transparent members 5 to leak out the light transferred from the LED 7 through the transparent members 5. The second positioning portions 643 going through the covering portion 64 for cooperating with the first positioning portions 113 so that the metallic shell 6 would be retained to the insulative housing 1.

Figure 2:
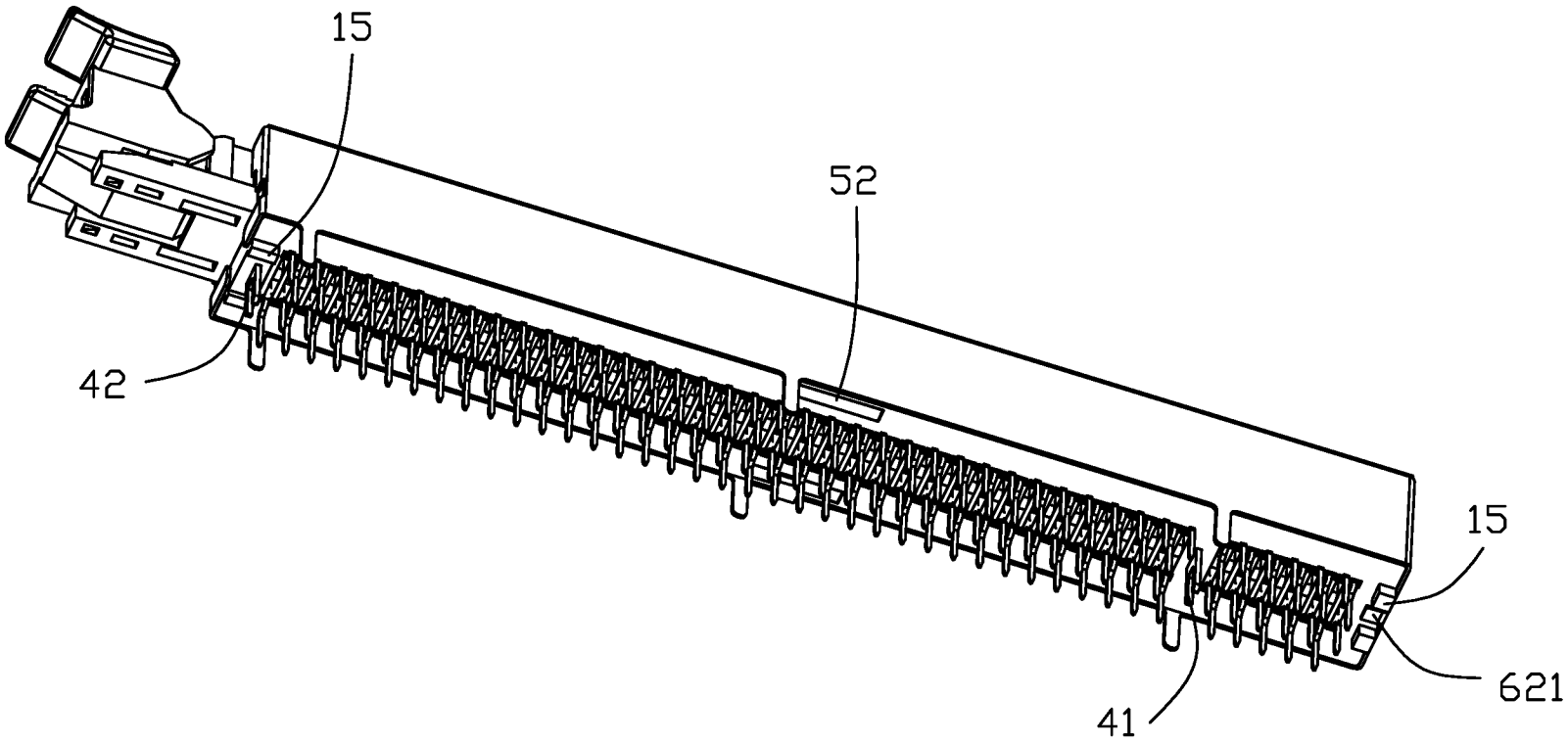
FIG. 2 is another perspective view of FIG. 1.
Figure 3:
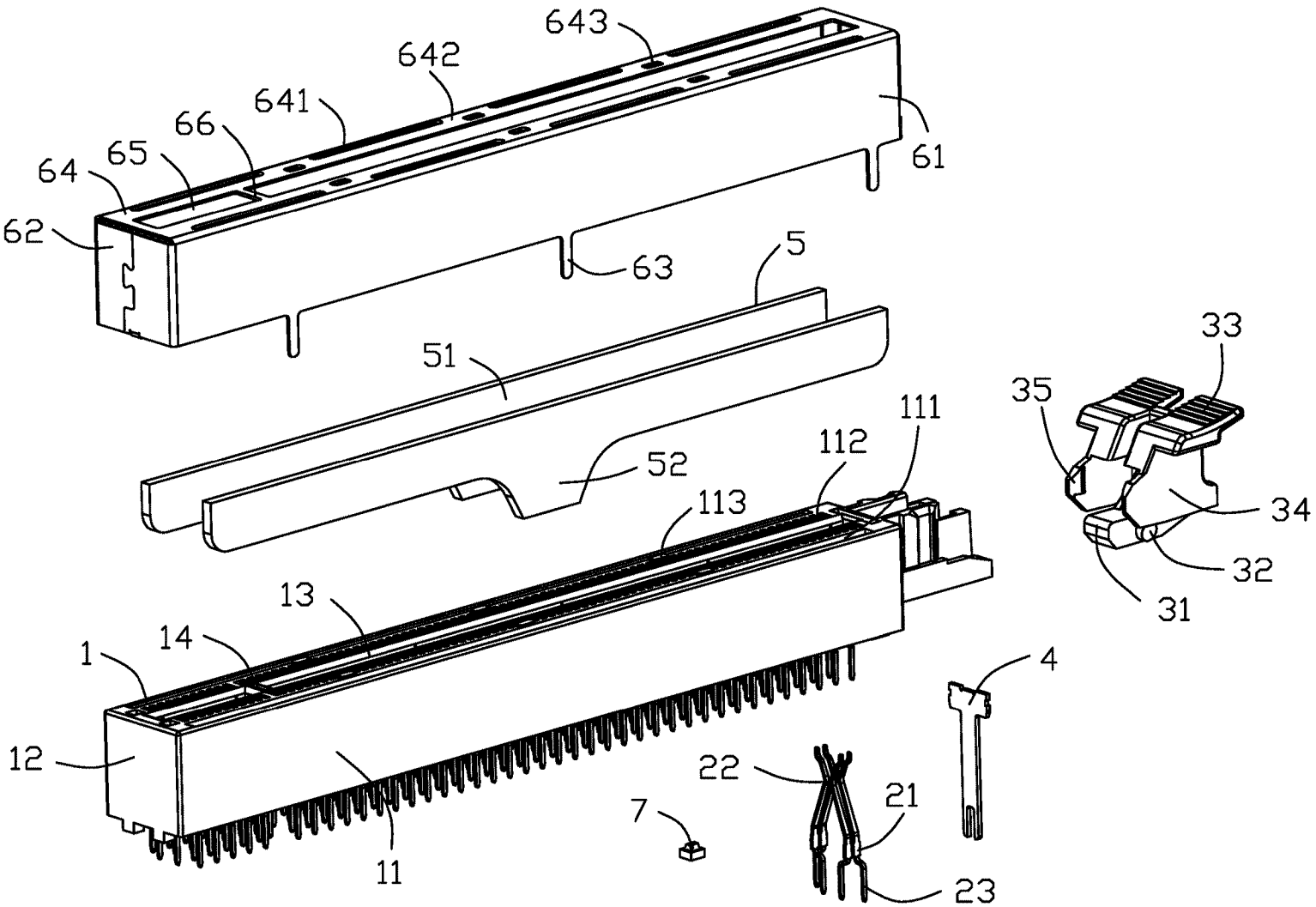
FIG. 3 is an exploded perspective view of the card edge connector of FIG. 1.
Figure 4:
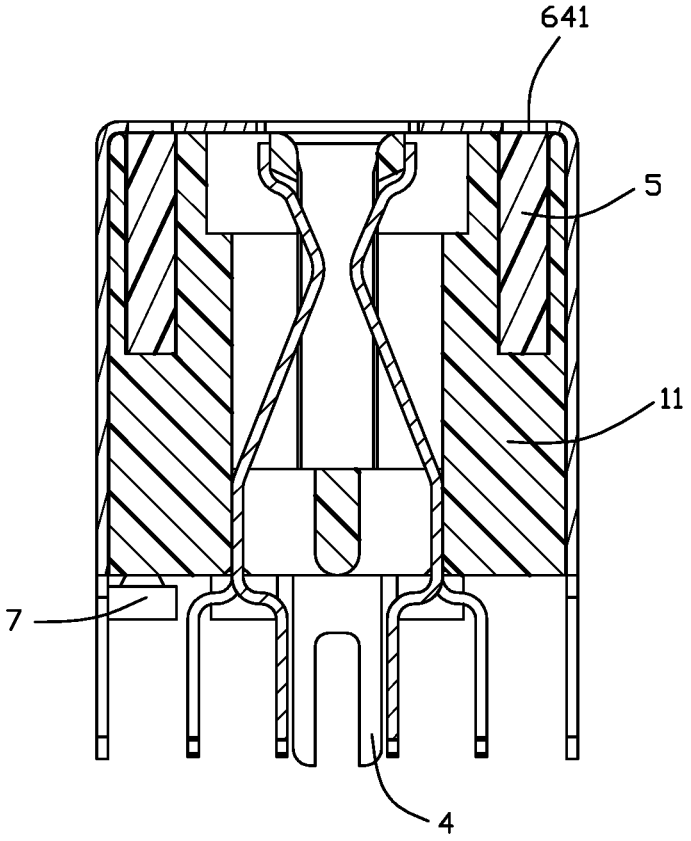
FIG. 4 is a cross-sectional view of the card edge connector of FIG. 1 taken along line 4-4 thereof.
Figure 5:
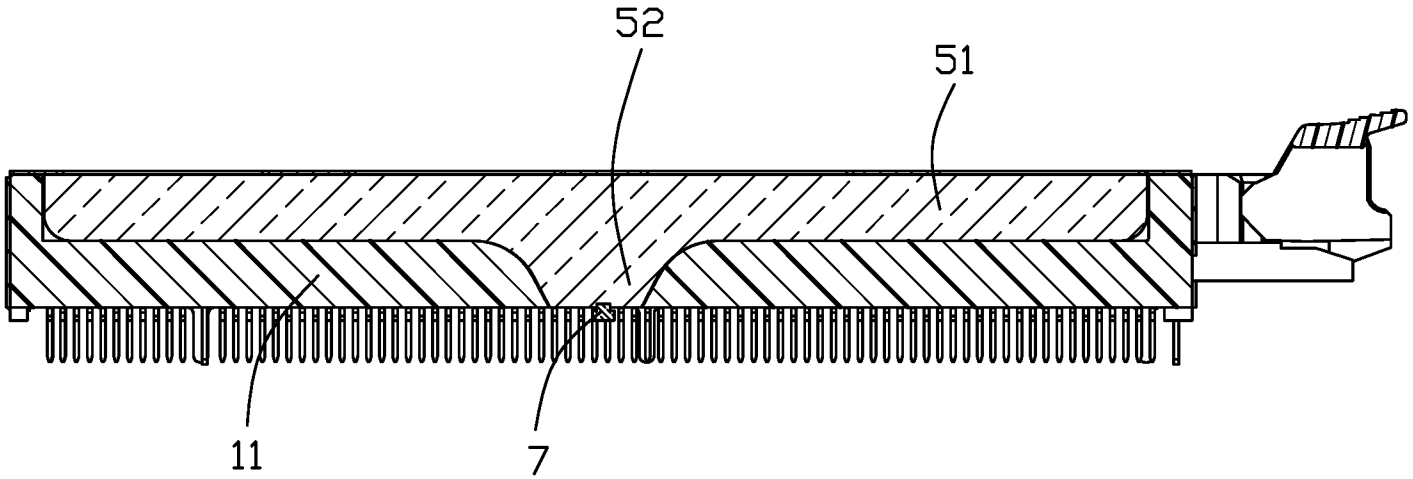
FIG. 5 is a cross-sectional view of the card edge connector of FIG. 1 taken along line 5-5 thereof.

Referring to FIG. 2, each of the short walls 62 has a holding pin 621 extending downwardly from a bottom side of the short wall 62. The holding pins 621 would be bended to be retained to a bottom surface of the insulative housing 1 to avoid the metallic shell 6 shaking. The insulative housing 1 has a lot of bumps 15 protruding downwardly from the bottom surface of the insulative housing 1 to reduce the manufacturing errors. The metallic members 4 includes a first member 41 located below the interval portion 14 and a second member 42 located below the end of the insulative housing 1 near to the ejector 3.

Figure 6:
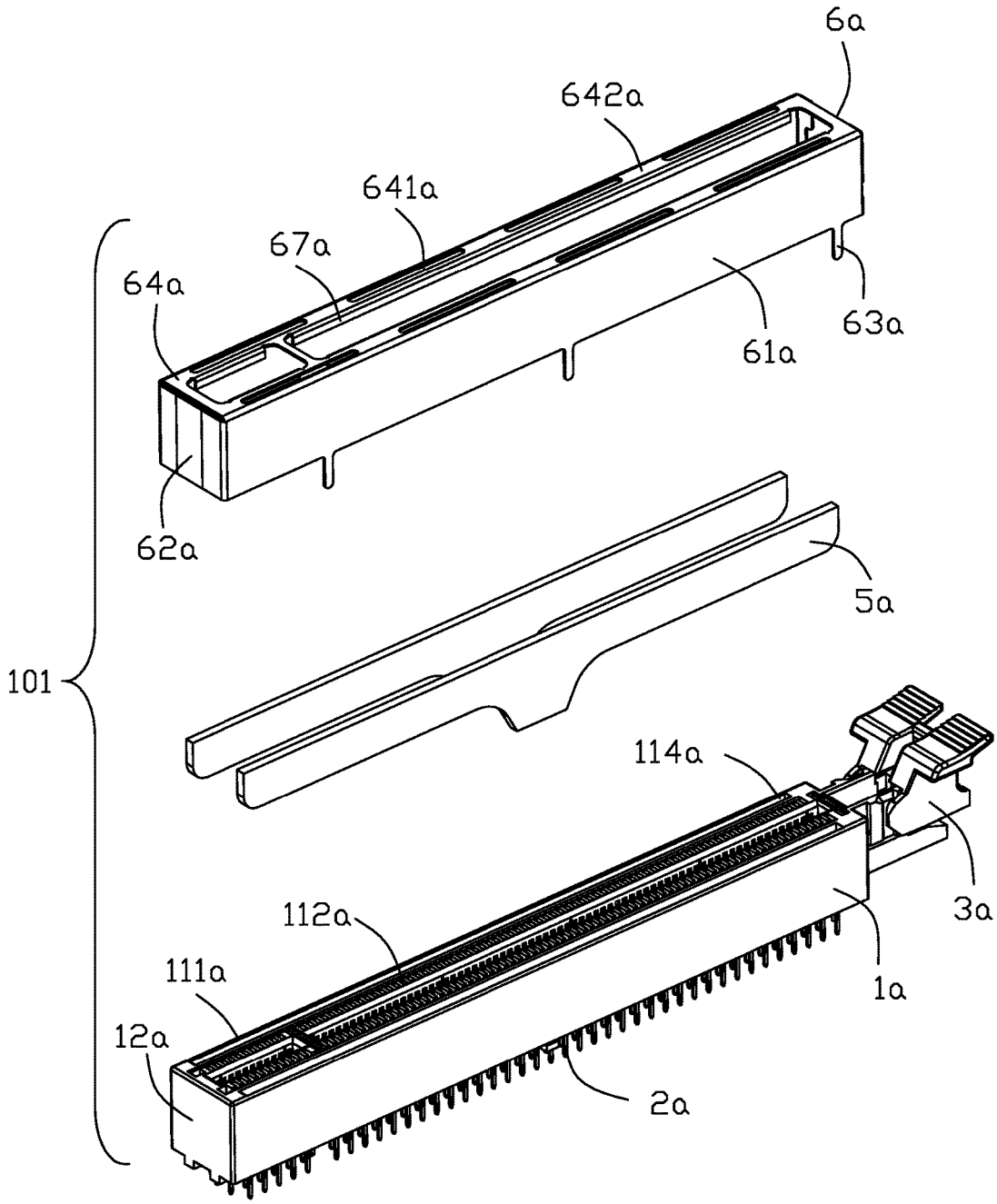
FIG. 6 is an exploded perspective view of a card edge connector according to a second embodiment of the present invention.
Figure 7:
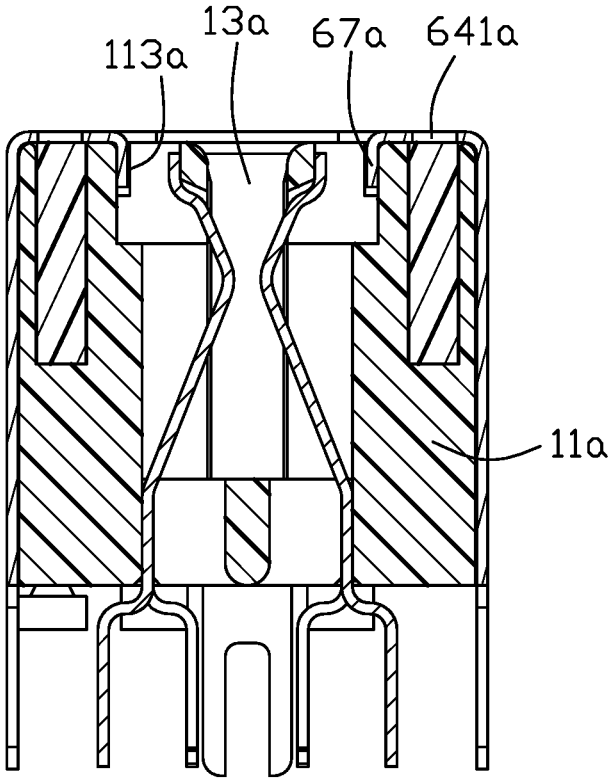
FIG. 7 is a cross-sectional view of the card edge connector of FIG. 6.

Reference will now be made in detail to a second embodiment of the present disclosure. Referring to FIGS. 6 and 7, a card edge connector 101 includes a longitudinal insulative housing 1*a*, a plurality of terminals 2*a* retained in the insulative housing 1*a*, an ejector 3*a* pivotally mounted to an end of the insulative housing 1*a*, a pair of transparent members 5*a* mounted to the insulative housing 1*a*, and a metallic shell 6*a* surrounding around the insulative housing 1*a*. The terminals 2*a*, the ejector 3*a*, and the transparent members 5*a* will not be described in detail because they are similar to the card edge connector 100 of the first embodiment.

The insulative housing 1*a* includes two side walls 11*a* extending along the longitudinal direction, two end walls 12*a* connecting between the longitudinal ends of the two side walls 11*a* and a center slot 13*a* defined therebetween. Each of the side walls 11*a* includes a plurality of terminal slots 112*a* communicating with the center slot 13*a*, a groove 111*a* for receiving the transparent member 5*a*, and a mounting slot 113*a* located between the groove 111*a* and the terminal slot 112*a* in a transverse direction. The grooves 111*a* go through the two top surfaces of the two side walls 11*a* so that the transparent members 5*a* would be exposed to the top surfaces of the side walls 11*a*, respectively. The mounting slot 113*a* communicates with the terminal slot 112*a*.

The metallic shell 6*a* includes two long walls 61*a* respectively covering the two side walls 11*a*, two short walls 62*a* connecting therebetween, a plurality of soldering pins 63*a* extending downwardly from a bottom side of the long walls 61*a*, and two covering portions 64*a* located above the two side walls 11*a* in the vertical direction, respectively. Each of the covering portions 64*a* extends from the top side of one side wall 11*a* to the center slot 13*a*. The metallic shell 6*a* further includes a pair of holding portions 67*a* respectively extending from the covering portions 64*a* to the center slot 13*a*. The holding portions 67*a* are bended downwardly into the mounting slot 113*a* to avoid the metallic shell 6*a* shaking. Each of the covering portions 64*a* includes a plurality of through-holes 641*a* arranged in a regular intervals manner along the longitudinal direction and a plurality of blocking portions 642*a* located between the through-holes 641*a*. The through-holes 641*a* are a plurality of long strip holes respectively located above the two transparent members 5*a* to leak out the light transferred therefrom.

Figure 8:
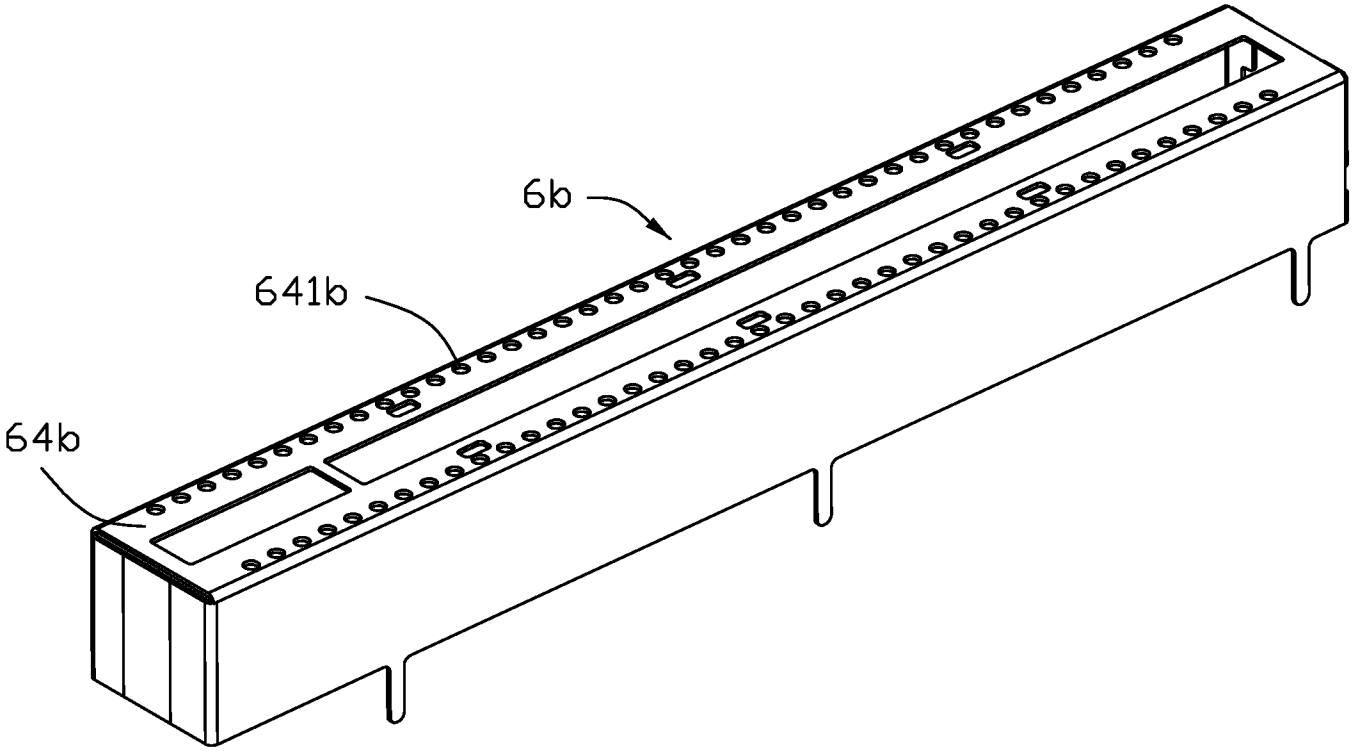
FIG. 8 is a perspective view of a metallic shell according to a third embodiment of the present invention.

FIG. 8 shows a card edge connector according to a third embodiment of the present invention. Compared to the metallic shell 6 of the card edge connector 100 of the first embodiment, the metallic shell 6*b* of the third embodiment only changes the structure of the through-holes 641*b* from the long strip shape to the interval circular holes to emit different light from the LED 7.

Figure 9:
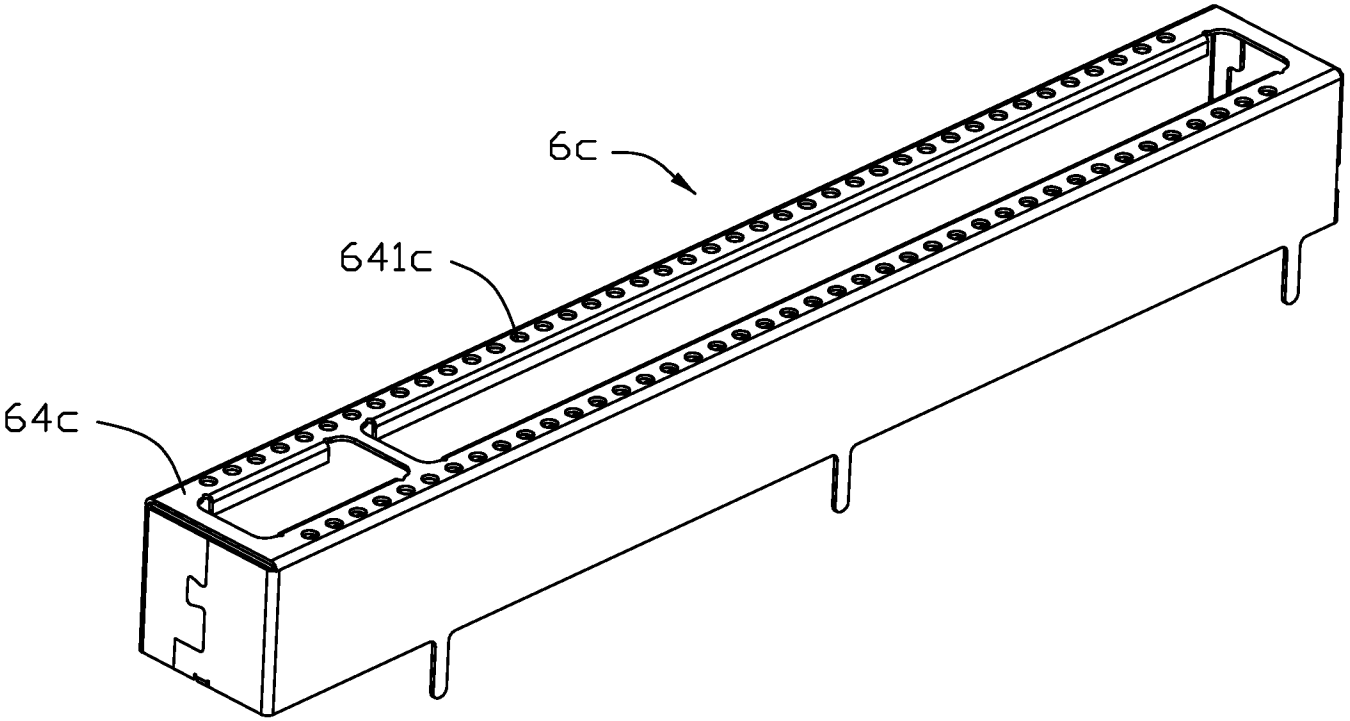
FIG. 9 is a perspective view of a metallic shell according to a fourth embodiment of the present invention.
Figure 10:
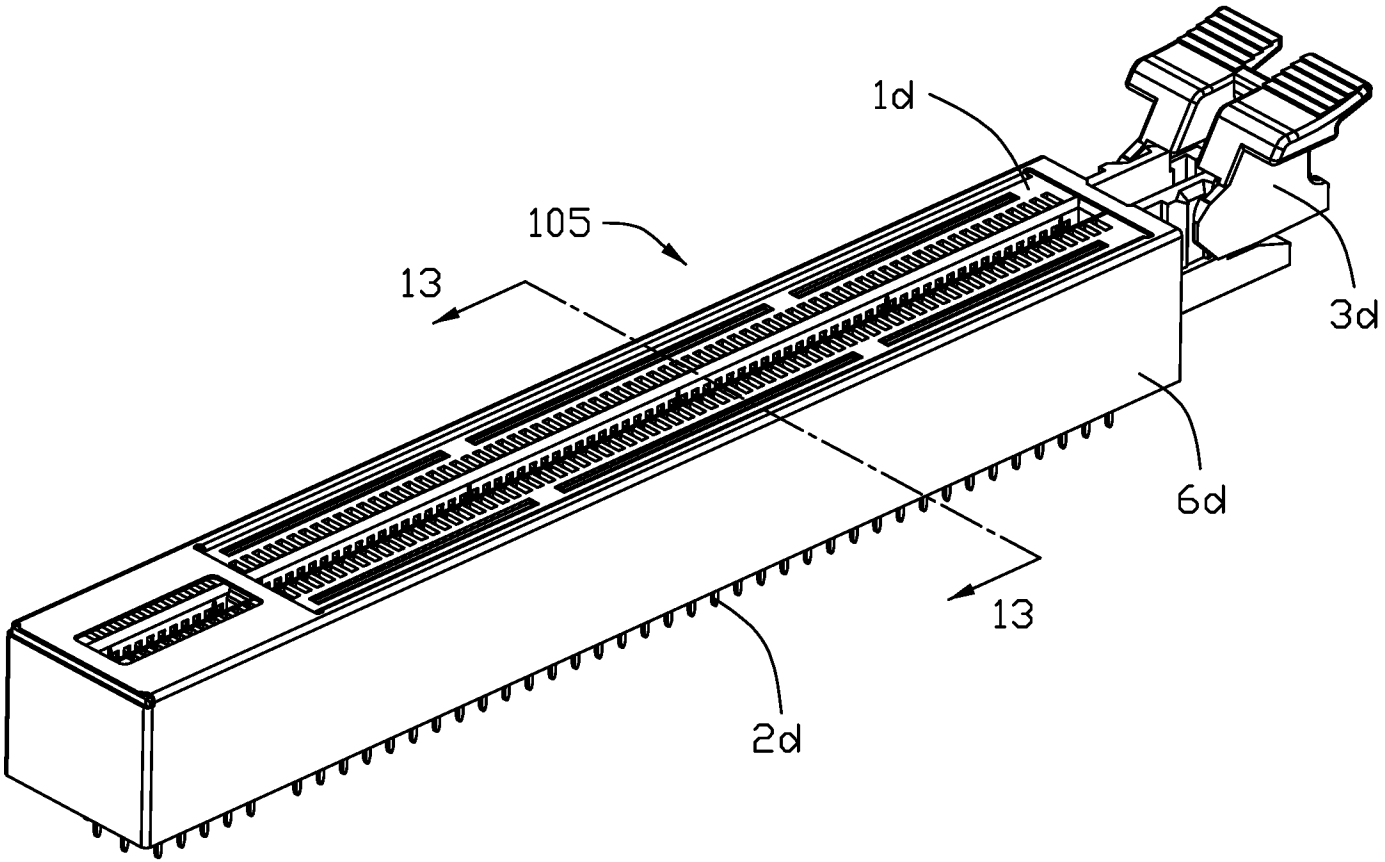
FIG. 10 is a perspective view of a card edge connector according to a fifth embodiment of the present invention.
Figure 11:
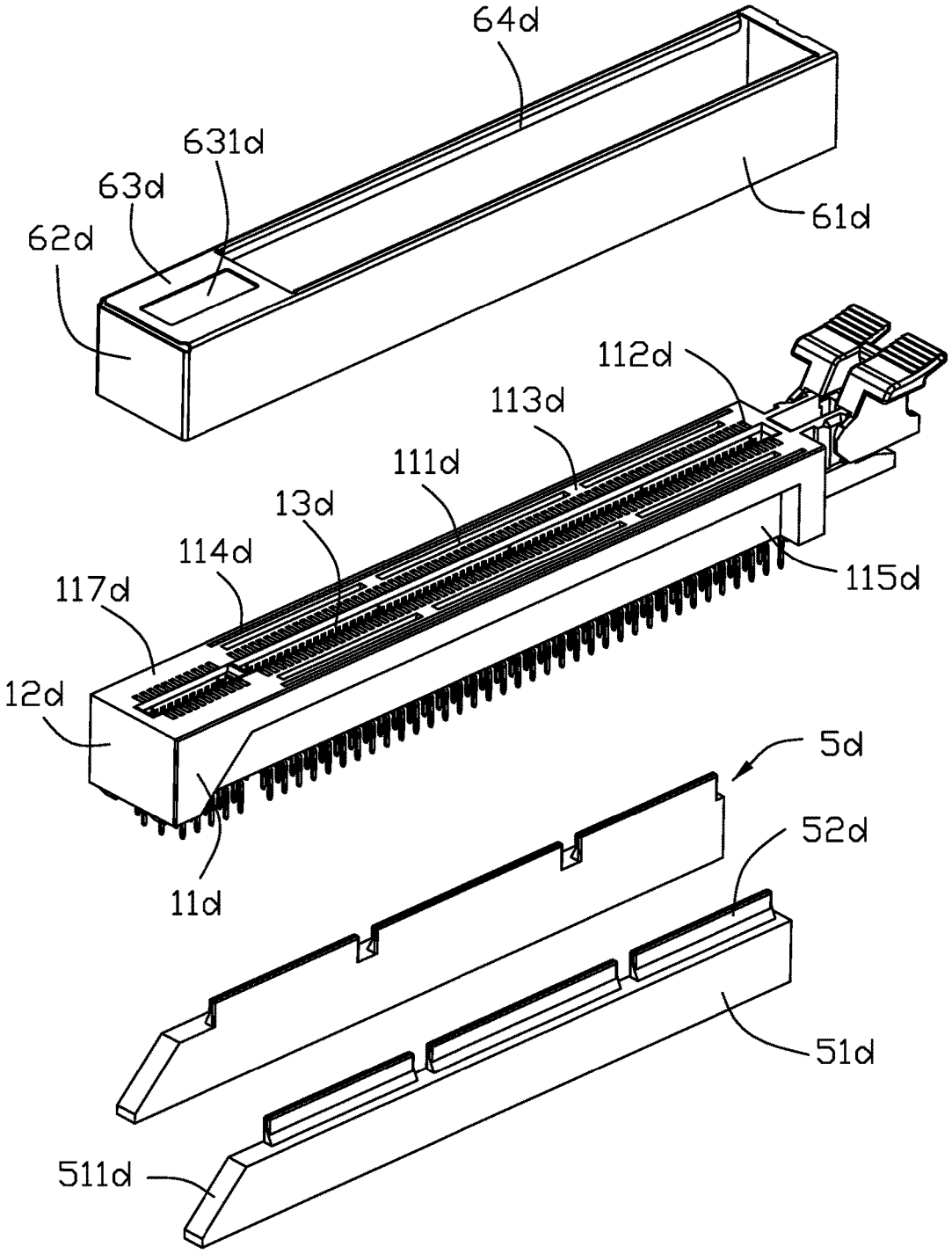
FIG. 11 is an exploded perspective view of the card edge connector of FIG. 10.
Figure 12:
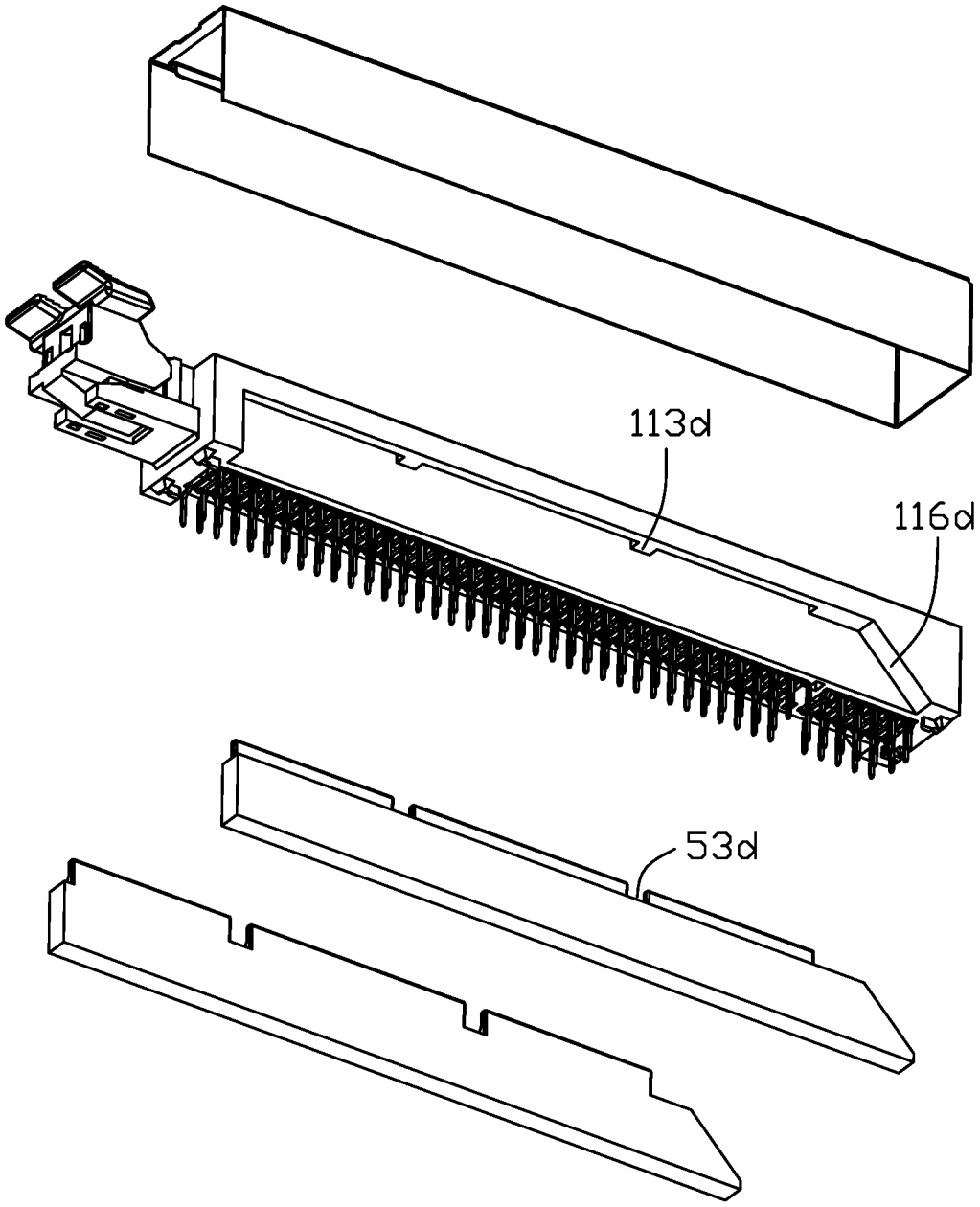
FIG. 12 is another exploded perspective view of FIG. 11.
Figure 13:
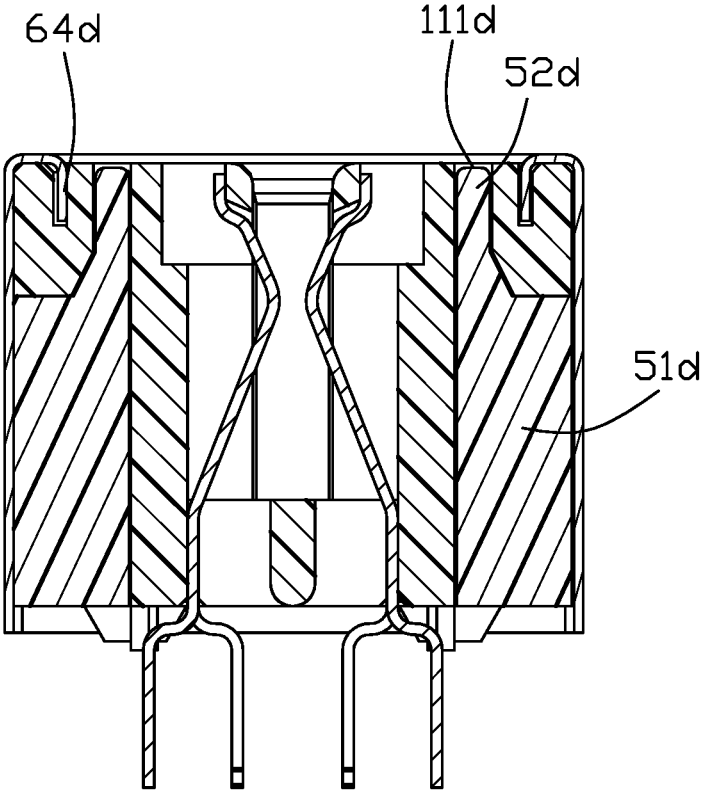
FIG. 13 is a cross-sectional view of the card edge connector of FIG. 10 taken along line 13-13 thereof.

FIG. 9 shows a card edge connector according to a fourth embodiment of the present invention. Compared to the metallic shell 6*a* of the card edge connector 101, the metallic shell 6*c* of the fourth embodiment only changes the structure of the through-holes 641*c* from the long strip shape to the interval circular holes to emit different light from the LED 7.

The transparent members of the card edge connectors of the first, second and third embodiments are loaded downwardly into the insulative housing in the vertical direction.

Reference will now be made in detail to a fifth embodiment of the present disclosure. Referring to FIGS. 10 to 13, a card edge connector 105 includes a longitudinal insulative housing 1*d*, a plurality of terminals 2*d* retained in the insulative housing 1*d*, an ejector 3*d* pivotally mounted to an end of the insulative housing 1*d*, a pair of transparent members 5*d* mounted to the insulative housing 1*d*, and a metallic shell 6*d* surrounding around the insulative housing 1*d*.

The insulative housing 1*d* includes two side walls 11*d* extending along the longitudinal direction, two end walls 12*d* connecting between the longitudinal ends of the two side walls 11*d* and a center slot 13*d* defined therebetween. Each of the side walls 11*d* includes a plurality of terminal slots 112*d* communicating with the center slot 13*d*, a plurality of through-holes 111*d* going through the two top surfaces of the two side walls 11*d*, a plurality of blocking portions 113*d* located between the through-holes 111*d*, and a pair of mounting slots 114*d* respectively going through the top surfaces of the side walls 11*d*. The through-holes 111*d* are a plurality of long strip holes arranged in a regular intervals manner along the longitudinal direction. The through-holes 111*d* of one side wall 11*d* are located between the terminal slots 112*d* and the mounting slot 114*d* in the transverse direction, respectively.

The insulative housing 1*d* includes a pair of grooves 115*d* going through two side faces of the side walls 11*d*, respectively. The through-holes 111*d* communicate with the grooves 115*d*. Each of the transparent members 5*d* includes a main portion 51*d* received in the groove 115*d*, a plurality of extending portions 52*d* extending upwardly from the main portion 51*d*, a plurality of notches 53*d* located between the extending portions 52*d*. The extending portions 52*d* are received in the corresponding through-holes 111*d* to be exposed to the top surface of the side wall 11*d*, while the blocking portions 113*d* are received in the corresponding notches 53*d*. The transparent member 5*d* includes a pair of inclined faces connecting between the main portion 51*d* and the extending portions 52*d* to prevent the right-angle structure from being broken easily. The main portion 51*d* includes a lead-in portion 511*d* at a longitudinal end thereof, while the insulative housing 1*d* has a corresponding lead-in surface 116*d*. A semi-closed structure 117*d* is provided at an end of the insulative housing 1*d* located corresponding to the lead-in surface 116*d*.

The metallic shell 6*d* includes two long walls 61*d* respectively covering the two side walls 11*d* and two short walls 62*d* connecting therebetween. The metallic shell 6*d* has a shrouding portion 63*d* covering on the semi-closed structure 117*d* of the insulative housing 1*d*. The shrouding portion 63*d* has a through slot 631*d* corresponding to the center slot 13. The metallic shell 6*d* further includes a pair of holding portions 64*d* extending from a top side of the long wall 61*d* to the center slot 13*d*. The holding portions 64*d* are bended downwardly into the mounting slot 114*d* to avoid the metallic shell 6*d* shaking.

In this embodiment, the LED 7 is mounted at a bottom surface of the insulative housing 1*d* corresponding to the semi-closed structure 117*d*. Therefore, the semi-closed structure 117*d* and the shrouding portion 63*d* would block the light from the LED 7. Then the light could be transferred to the extending portions 52*d* by the lead-in portion 511*d*.

Figure 14:
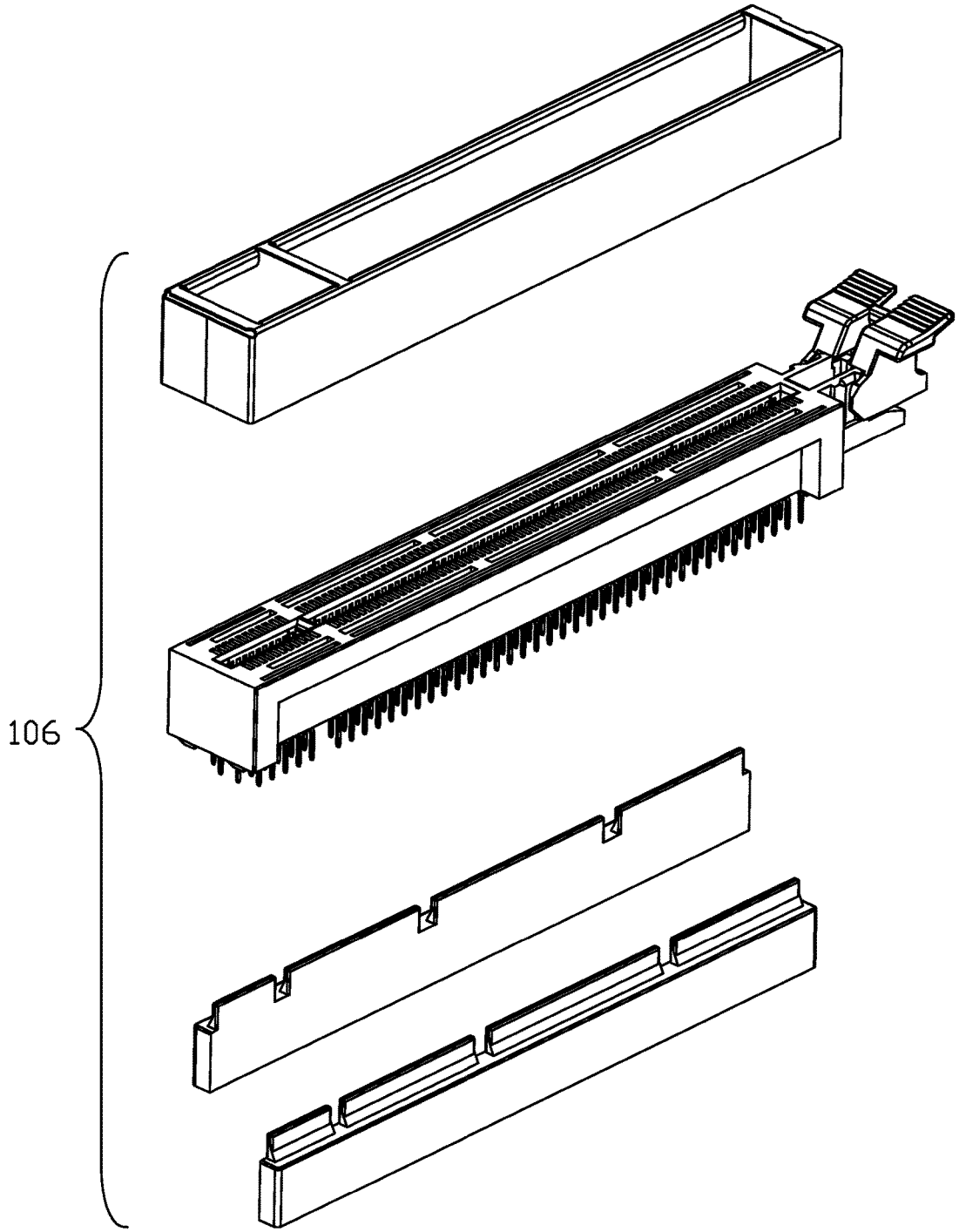
FIG. 14 is an exploded perspective view of a card edge connector according to a sixth embodiment of the present invention.

FIG. 14 shows a card edge connector 106 according to a sixth embodiment of the present invention. Compared to the fifth embodiment above, the shrouding portion 63*d*, the semi-closed structure 117*d* and the lead-in portion 511*d* are all removed because the LED 7 is mounted at the middle bottom of the insulative housing.

Figure 15:
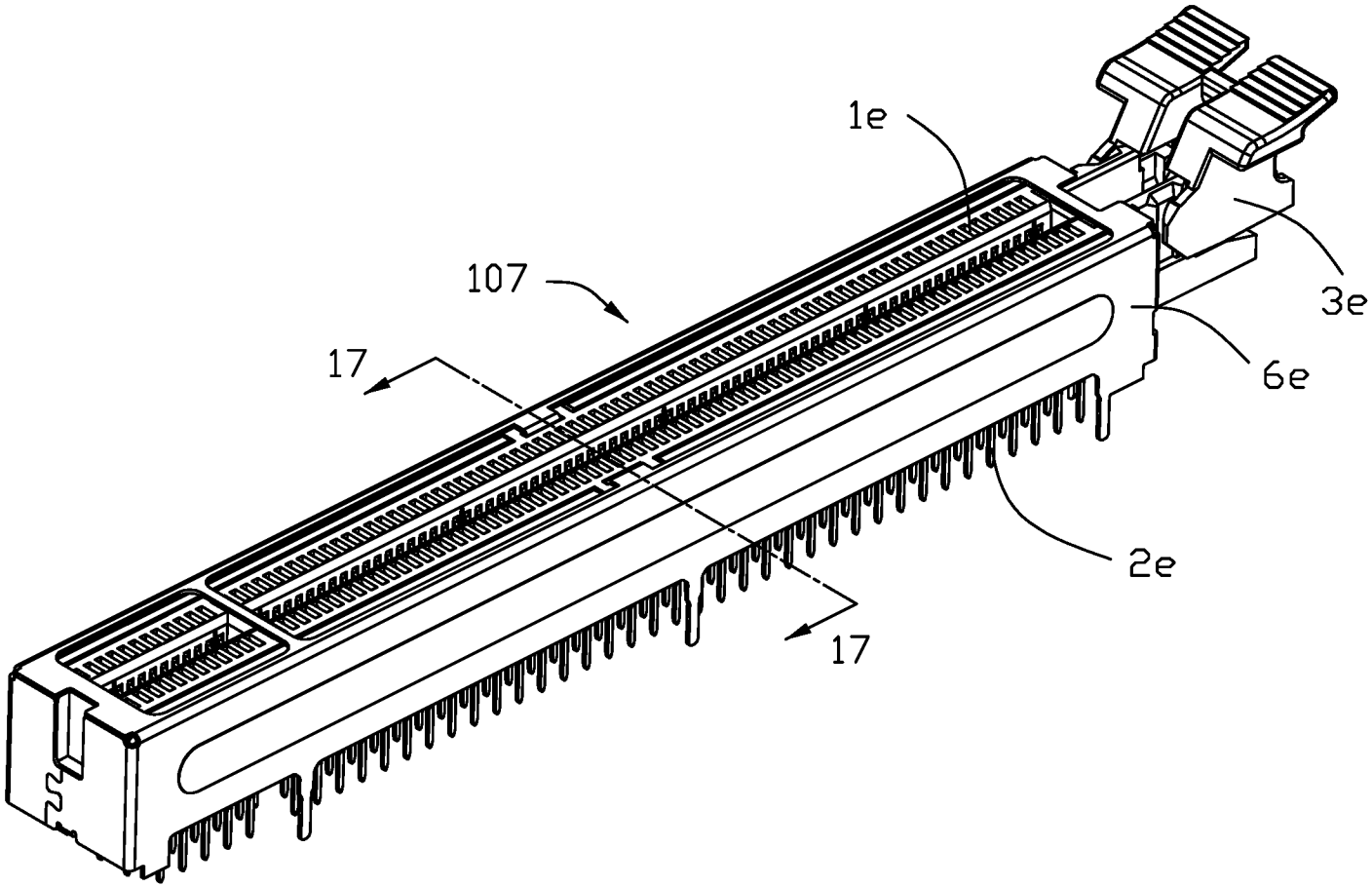
FIG. 15 is an perspective view of a card edge connector according to a seventh embodiment of the present invention.
Figure 16:
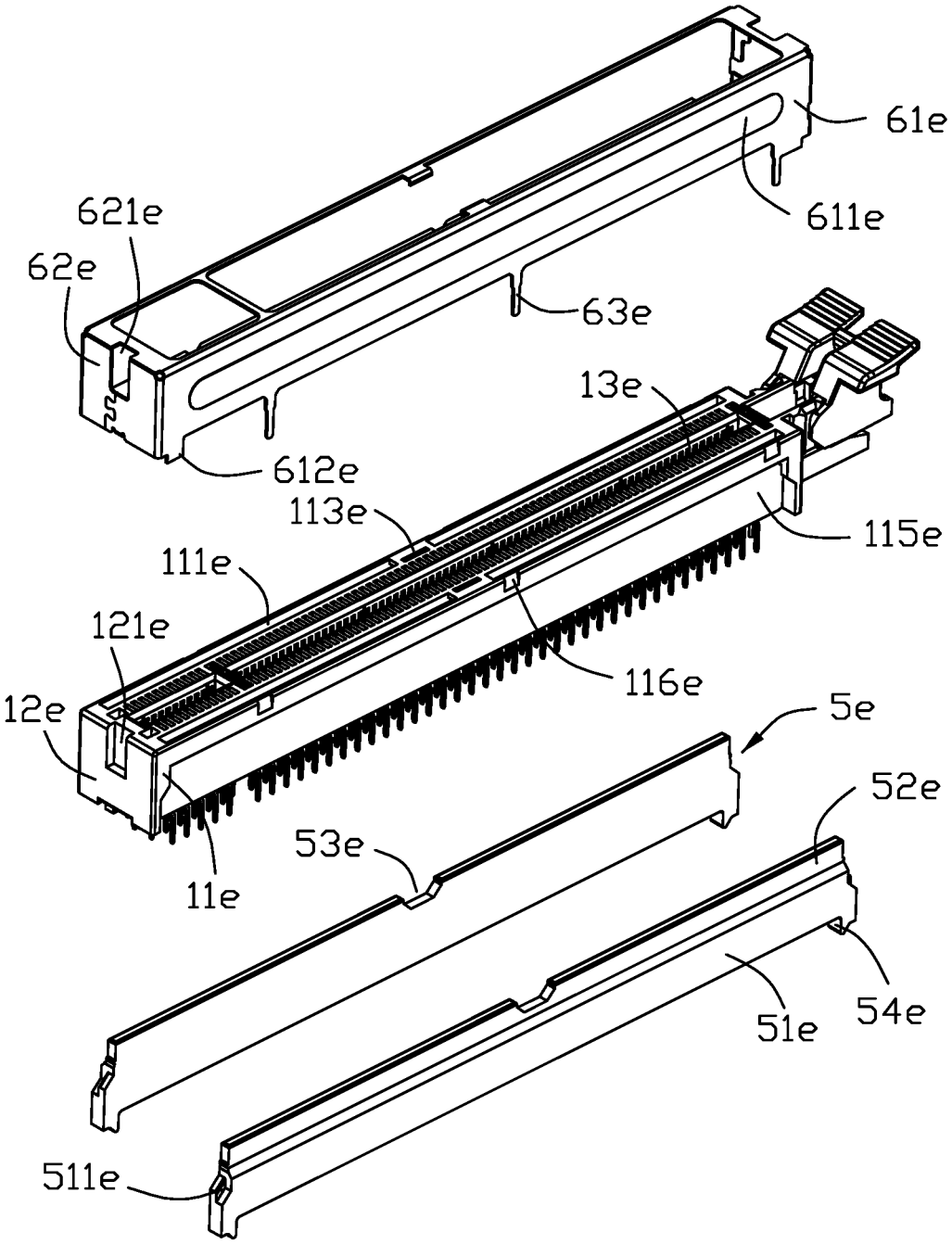
FIG. 16 is an exploded perspective view of the card edge connector of FIG. 15.
Figure 17:
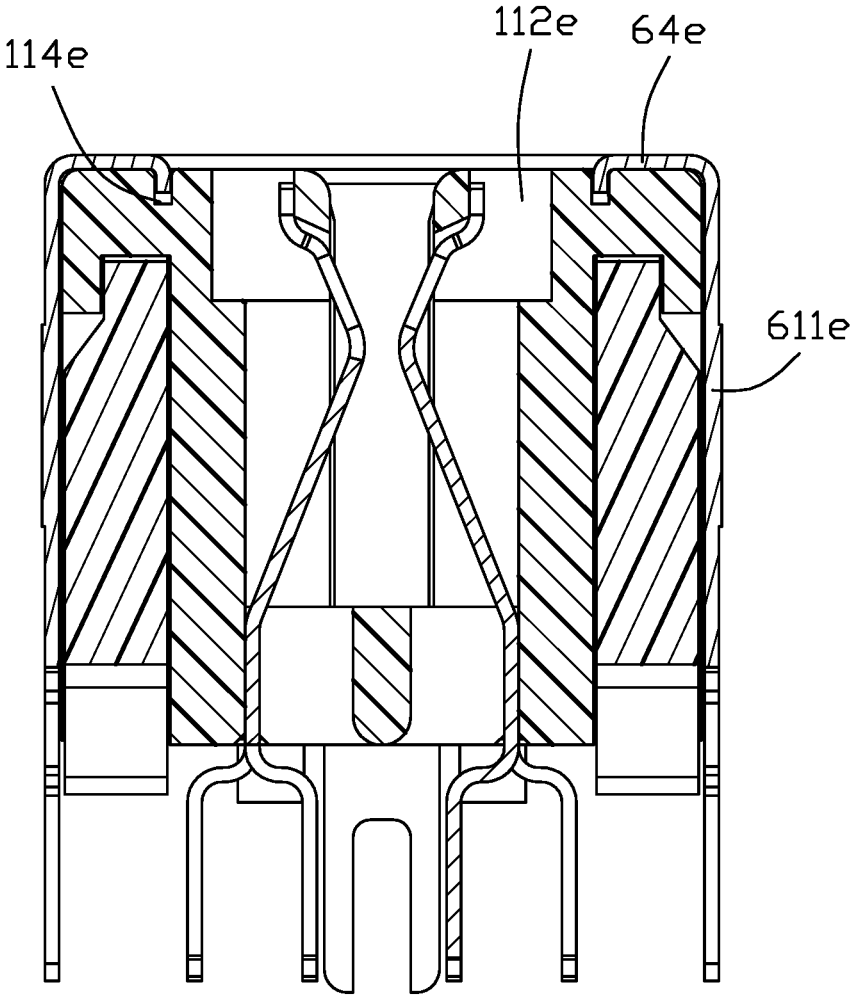
FIG. 17 is a cross-sectional view of the card edge connector of FIG. 15 taken along line 17-17 thereof.

Reference will now be made in detail to a seventh embodiment of the present disclosure. Referring to FIGS. 15 to 17, a card edge connector 107 includes a longitudinal insulative housing 1*e*, a plurality of terminals 2*e* retained in the insulative housing 1*e*, an ejector 3*e* pivotally mounted to an end of the insulative housing 1*e*, a pair of transparent members 5*e* mounted to the insulative housing 1*e*, and a metallic shell 6*e* surrounding around the insulative housing 1*e*.

The insulative housing 1*e* includes two side walls 11*e* extending along the longitudinal direction, two end walls 12*e* connecting between the longitudinal ends of the two side walls 11*e* and a center slot 13*e* defined therebetween. Each of the side walls 11*e* includes a plurality of terminal slots 112*e* connecting with the center slot 13*e*, a pair of through-holes 111*e* respectively going through the two top surfaces of the two side walls 11*e*, and a pair of blocking portions 113*e* respectively located at the middle of the through-holes 111*e* to divided the through-hole 111*e* into two parts. The blocking portion has a mounting slot 114*e* going through a top surface thereof. The depth of the mounting slot 114*e* is smaller than the depth of the through-hole 111*e* in the vertical direction. The insulative housing 1*e* includes a pair of grooves 115*e* going through two side faces of the side walls 11*e*, respectively. One of the end walls 12*e* has a breach 121*e* going through a side face thereof.

Each of the transparent members 5*e* includes a main portion 51*e* received in the groove 115*e*, an extending portion 52*e* extending upwardly from a top side of the main portion 51*e*, and a notch 53*e* located at the middle of extending portion 51*e* to divided the extending portion 52*e* into two parts corresponding to the through-hole 111*e*. The extending portion 52*e* is received in the through-hole 111*e* and exposed to the top surface of the side wall 11*e*. The transparent member 5*e* includes a pair of inclined faces connecting between the main portion 51*e* and the extending portion 52*e* to prevent the right-angle structure from being broken easily. The main portion 51*e* includes a pair of ribs 511*e* located at the two longitudinal ends thereof, while the insulative housing 1*e* includes two corresponding notches. When the transparent members 5*e* are inserted in the grooves 115*e*, the ribs 511*e* are inserted in the notches for mounting the transparent members 5*e* to the insulative housing 1*e* tightly. Then, the blocking portions 113*e* are received in the notches 53*e*. Each of the transparent members 5*e* has two pins 54*e* located at two ends of the main portion 51*e*.

The metallic shell 6*e* includes two long walls 61*e* respectively covering the two side walls 11*e*, two short walls 62*e* connecting therebetween, and a plurality of soldering pins 63*e* extending downwardly from the long walls 61*e*. Each of the long walls 61*e* includes an elongated convex hull 611*e* protruding outwardly at middle of the long wall 61*e* and two shrouding parts 612*e* extending downwardly from two ends of the long wall 61*e* for covering the two pins 54*e*. One of the two short walls 62*e* has an opening 621*e* corresponding to the breach 12*e*. The metallic shell 6*e* includes a pair of holding portions 64*e* respectively extending from a top side of the two long walls 61*e* to the center slot 13*e*. The holding portions 64*e* are bended into the corresponding mounting slots 114*e* to prevent the metallic shell 6*e* from shaking. Each of the side walls 11*e* includes a plurality of lead-in portions or recesses 116*e* at the top side of the side wall 11*e* for guiding the soldering pins 63*e* during assembling the metallic shell 6*e* unto the housing 1*e*, thus avoiding improper deflection of the soldering pines during assembling.

One main feature of the present invention described above provides long strip light transferring/transmitting holes 641, 641*a* or dense circular light transferring/transmitting holes 641*b*, 641*c* in the metallic shell 6, 6*a*, 6*b*, 6*c*, or long strip light transferring/transmitting holes 111*d*, 111*e* in the insulative housing 1*d*, 1*e* to achieve variety of light effects so that the light may be directly spread out via the transferring holes 111 of the housing 1 if the shell 6 has no corresponding portion covering such areas, or further via the transferring hole 641 of the shell if the shell 6 has corresponding covering portion shielding such areas. Notably, the transferring holes 111 of the housing 1 and the transferring holes 641 of the shell 6 may be of one-to-one relation or one-to-more relation based upon the consideration of manufacturability and strength thereof. In addition, having the housing confine the transparent member is more stable than having the transparent member confined by the metallic shell in a technical viewpoint. In other words, the transparent member 5 is retained to the housing 1 rather than to the metallic shell for reliable fixation. Correspondingly, corresponding parts of the transparent member 5 around the corresponding transferring holes should be sandwiched or held by the housing 1 rather than sidewardly exposed to the metallic shell in the transverse direction. Another feature of the present invention is to have the preformed metallic shell 6 assembled unto the housing 1 instead of insert-molded within the housing for manufacturability consideration. Another feature of the invention is to have the transparent members 5 have the extending portion 52 reaching the bottom of the housing so as to be close to the LED 7 for efficient light transmission.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. A card edge connector comprising:

a longitudinal insulative housing having two side walls extending along a longitudinal direction, two end walls extending along a transverse direction perpendicular to said longitudinal direction and connecting between the longitudinal ends of the two side walls and a center slot defined therebetween;

a plurality of terminals retained in the said walls, respectively;

a pair of transparent members fixed to the said walls, respectively;

a metallic shell surrounding around the insulative housing; wherein the metallic shell comprises two covering portions respectively located above top surfaces of the two side walls in a vertical direction perpendicular to both of the longitudinal direction and the transverse direction, each of the covering portions comprises a plurality of through-holes arranged along the longitudinal direction and located above the transparent members to leak out the light transmitted therefrom; and each of the transparent members comprises a longitudinal main portion and an extending portion extending downwardly therefrom, and the extending portion is exposed to a bottom surface of the side wall.

2. The card edge connector as claimed in claim 1, wherein each of the side walls comprises a groove going through a top surface of the side wall along the vertical direction, and the transparent members are received in the grooves and exposed to the top surface of the side walls, respectively.

3. The card edge connector as claimed in claim 1, wherein the through-holes are a plurality of circular holes or long strip holes arranged in a regular intervals manner along the longitudinal direction.

4. The card edge connector as claimed in claim 3, wherein each of the side walls comprises a plurality of first positioning portions protruding upwardly from a top surface of the side wall, each of the covering portions comprises a plurality of second positioning portions corresponding to the first positioning portions, and the second positioning portions are located between the through-holes and the center slot in the transverse direction.

5. A card edge connector comprising:

a longitudinal insulative housing having two side walls extending along a longitudinal direction, two end walls connecting between the longitudinal ends of the two side walls and a center slot defined therebetween;

a plurality of terminals retained in the insulative housing;

a pair of transparent members fixed to the insulative housing;

a metallic shell surrounding around the insulative housing; wherein each of the side walls comprises a plurality of through-holes going through a top surface of the side wall, and the through-holes are arranged along the longitudinal direction and respectively located above the two transparent members to spread out the light transmitted therefrom; and each of the side walls comprises a groove communicating with the through-holes, each of the transparent members comprises a longitudinal main portion received in the groove and a plurality of extending portions extending upwardly therefrom, and the extending portions are received in the through-holes and exposed to the top surface of the side walls.

6. The card edge connector as claimed in claim 5, wherein the through-holes are a plurality of long strip holes arranged in a regular intervals manner along the longitudinal direction, and the extending portions are arranged corresponding to the long strip holes.

7. The card edge connector as claimed in claim 5, wherein the metallic shell comprises two long walls respectively covering the two side walls and two holding portions extending from a top side of the corresponding long walls, and both of the holding portions are bended into the center slot.

8. The card edge connector as claimed in claim 5, wherein the main portion has a lead-in portion, and the metallic shell comprises a shrouding portion covering on an end of the insulative housing corresponding to the lead-in portion.

9. A card edge connector comprising:

an insulative housing defining a pair of opposite side walls each extending along a longitudinal direction, a pair of end walls connected at two longitudinal ends of the pair of side walls, and a center slot formed between said pair of side walls in a transverse direction perpendicular to said longitudinal direction, each of said side walls forming a top surface in a vertical direction perpendicular to both said longitudinal direction and said transverse direction;

a plurality of terminal slots formed in each of said side walls and communicating the center slot in the transverse direction;

at least one ejector located by one end wall of said housing;

two rows of terminals disposed in the corresponding terminal slots of said side walls, respectively;

a pair of essentially thin planar light guide members associated with the corresponding side walls, respectively;

an LED (Light-Emitting Diode) being located under each of said light guide members to transmit light toward the corresponding light guide member; and a metallic shell attached upon the housing and covering said pair of side walls, wherein the pair of light guide members are retained in the corresponding side walls, respectively, and each of said side walls forms upward holes aligned with the corresponding light guide member in the vertical direction to allow light from the corresponding light guide member to be upwardly efficiently spread out via said holes.

10. The card edge connector as claimed in claim 9, wherein said shell covers a top surface of each of said side walls, and further defines a plurality of holes aligned with the corresponding holes of the housing in the vertical direction for allow said light to be upwardly spread out.

11. The card edge connector as claimed in claim 9, wherein the metallic shell is preformed to be of a complete configuration and downwardly assembled upon the housing in the vertical direction, and further includes a plurality of downwardly extending soldering pins at a bottom portion thereof.

12. The card edge connector as claimed in claim 11, wherein the housing forms a plurality of recesses aligned with the corresponding soldering pins in the vertical direction, respectively.

13. The card edge connector as claimed in claim 9, wherein said metallic shell includes a holding portion located on a top surface of each corresponding side wall and downwardly extending into the housing for preventing the shell from moving outwardly and sidewardly in the transverse direction.

14. The card edge connector as claimed in claim 13, wherein said holding portion is located between the upward holes of the corresponding side wall and the center slit in the transverse direction.

15. The card edge connector as claimed in claim 14, wherein said holding portion extends into the corresponding terminal slots.

16. The card edge connector as claimed in claim 13, wherein said holding portion is located outside of both the upward holes and the terminal slots of the corresponding side wall in the transverse direction.

17. The card edge connector as claimed in claim 9, wherein each of said side walls forms a groove to receive the corresponding light guide members therein.

18. The card edge connector as claimed in claim 17, wherein said groove is not outwardly exposed to the metallic shell in the transverse direction.

* * * * *